United States Patent [19]

Santangelo et al.

[11] Patent Number: 4,512,403

[45] Date of Patent: Apr. 23, 1985

[54] IN SITU COAL GASIFICATION

[75] Inventors: Joseph G. Santangelo; John M. Fernbacher, both of Allentown, Pa.

[73] Assignee: Air Products and Chemicals, Inc., Allentown, Pa.

[21] Appl. No.: 357,525

[22] Filed: Mar. 12, 1982

Related U.S. Application Data

[63] Continuation-in-part of Ser. No. 174,470, Aug. 1, 1980, abandoned.

[51] Int. Cl.[3] ..... E21B 43/243

[52] U.S. Cl. ..... 166/261; 166/57; 166/316

[58] Field of Search ..... 166/251, 256, 259, 260, 166/261, 316, 59, 57; 299/2

[56] References Cited

U.S. PATENT DOCUMENTS

| | | | |
|---|---|---|---|
| 2,506,853 | 5/1950 | Berg et al. | 166/59 |
| 2,771,951 | 11/1956 | Simm | 166/256 |
| 2,801,089 | 7/1957 | Scott, Jr. | 166/260 X |
| 2,985,240 | 6/1961 | Emery | 166/59 |
| 3,147,804 | 9/1964 | Wyllie | 166/261 X |
| 3,298,434 | 1/1964 | Graham . | |
| 3,344,856 | 10/1967 | Lange | 166/261 X |
| 3,734,184 | 5/1973 | Scott | 166/259 |
| 3,770,398 | 11/1973 | Abraham et al. | 48/202 |
| 3,856,084 | 12/1974 | Parsons | 166/257 |
| 3,952,801 | 4/1976 | Burton, III | 166/256 |
| 3,978,920 | 9/1976 | Bandyopadhay et al. | 166/258 |
| 3,999,607 | 12/1976 | Pennington et al. | 166/259 |
| 4,026,357 | 5/1977 | Redford | 166/261 |
| 4,078,613 | 3/1978 | Hamrick et al. | 166/302 |
| 4,099,567 | 7/1978 | Terry | 166/261 |

*Primary Examiner*—George A. Suchfield

*Attorney, Agent, or Firm*—Thomas G. Ryder; E. Eugene Innis; James C. Simmons

[57] ABSTRACT

In an injection well for underground gasification of carbonaceous materials, either liquids or solids, by partial combustion with oxygen-rich gas in the presence of a moderating fluid such as steam, air, $CO_2$ or the like, in which the moderating fluid is introduced through an annular path surrounding the injection tube through which the oxygen-rich gas is injected, back flow of gasification products from the well is prevented by providing a flow restriction in the annular path to increase the linear flow velocity of the moderating fluid while maintaining the designed mass flow rate of said moderating fluid. The flow restriction is so designed that at the predetermined downward flow rate of said moderating fluid the critical velocity of the moderating fluid at the restriction corresponds to the formula:

$$V_c=\sqrt{gD}$$

wherein g is the gravity constant, D is the equivalent diameter of the largest opening in the restriction.

8 Claims, 4 Drawing Figures

IN SITU COAL GASIFICATION

RELATED APPLICATIONS

This application is a continuation-in-part of application Ser. No. 174,470, filed Aug. 1, 1980, now abandoned.

BACKGROUND OF THE INVENTION

The present invention relates to the gasification of coal or other carbonaceous materials, either liquids or solids, in an underground location, by in situ conversion including partial combustion and distillation of volatiles.

The production of gaseous products by reacting coal in subterranean deposits with steam and oxygen-containing gas is amply described in issued patents and in technical literature. In a typical operation spaced apart wells are drilled through the overburden to the coal seam, one to serve as an injection well and the other as a production well. By the various methods well known in the art, an underground linking channel is established for gas flow communication from the injection well to the production well. By introduction of air or other oxygen-containing gas and steam through the injection well at elevated temperature, various reactions may ensue, depending on conditions employed, giving rise to vaporization of liquid hydrocarbons and to the production of hydrogen, carbon monoxide, carbon dioxide and possibly methane, as exemplified by the following type reactions:

$$2C+O2\rightarrow 2CO$$

$$C+O_2\rightarrow CO_2$$

$$C+H_2O\rightarrow H_2+CO$$

$$2C+2H_2O\rightarrow CH_4+CO_2$$

$$CO+H_2O\rightarrow CO_2+H_2$$

$$2C+H_2O\rightarrow H_2+2CO$$

$$C_xH_y+(x/2)O_2\rightarrow xCO+(y/2)H_2$$

The composition of the gas product obtained as a result of these competing chemical reactions will depend largely upon prevailing temperature at the site of the reaction and to the relative quantities of $H_2O$ and $O_2$ there available. Different modes of operation have been proposed as to the injection of the reactant fluids; thus while some prefer to inject oxygen-containing gas and steam simultaneously into the coal strata, others advocate that the injection of the steam and oxygen-containing gas be alternated. Some of the available alternatives in coal gasification are discussed in U.S. Pat. No. 3,978,920.

Instead of spaced apart wells for injection and production respectively, it is also known to employ a single well, wherein an injection tube is provided concentric to an outer casing or bore pipe, as seen, for example in U.S. Pat. Nos. 3,298,434 and 3,856,084. Reactant fluids are introduced to the coal strata through the injection tube and the gaseous reaction products withdrawn in the annulus between the inner pipe and the bore pipe.

In some instances, as seen for example in U.S. Pat. No. 3,999,607, although separate spaced apart wells are employed for injection and production respectively, each of these wells or the injection well alone may be provided with an outer bore pipe or casing and an inner concentric injection tube. In such arrangement oxygen-rich gas may be injected through the inner tube and a moderating fluid such as steam injected into the concentric annulus formed between the inner tube and the outer casing or well wall. The moderating fluid may be injected simultaneously or intermittently with the oxygen to reduce oxidation reaction temperature and may comprise steam, water, $N_2$ or $CO_2$ (U.S. Pat. No. 4,026,357).

Other U.S. patents of interest relating to underground coal gasification include: U.S. Pat. Nos. 3,734,184; 3,770,398; and 4,099,567.

In installations wherein an injection well is employed in which oxygen is introduced into the coal strata through an inner tube and the moderating fluid flows down the annulus between the inner tube and the casing, there is the danger of back flow of combustible gas into the annular space with the possible formation of a potentially explosive mixture. Such flow of combustible gas into the annulus could be prevented if the flow rate of the moderating fluid is sufficiently high. The relative flow rates of steam or other moderating fluid to the oxygen flow rate must be set to foster the desired reactions in the combustion zone. Thus, depending upon the relative geometry of the annulus and the injection tube, rates of downward flow of moderating fluid large enough to purge the annulus properly may be too high relative to the coal gasification reaction requirements. The same techniques and problem also exist regarding liquid carbonaceous deposits. This problem is overcome by the present invention, which allows the introduction of moderating gas in sufficient quantities to satisfy the annular purge requirements while at the same time satisfying the requirements of the desired gasification reaction.

SUMMARY OF THE INVENTION

This invention is directed to a procedure to be employed in connection with certain processes for the underground gasification of carbonaceous material in situ utilizing a bored injection well. The particular method of this invention comprises injecting oxygen-rich gas through a conduit within the well bore or casing while flowing a combustion moderating fluid downwardly in a concentric annular path flowing externally of the conduit, i.e. in the annular area defined between the conduit and the well bore or casing. The combustion moderating fluid is flowed at a predetermined mass flow rate which is sufficient to satisfy the requirements of the gasification product composition. The particular improvement of this invention comprises placing a restriction in the flow path of the moderating fluid such that at the predetermined mass flow rate the average flow velocity is at least equal to the critical flow velocity ($V_c$) for the largest opening in the restriction. In this connection, "average flow velocity" is defined as the volumetric flow rate at the conditions existent at the restriction divided by the total open area at the restriction. Also, the critical flow velocity is calculated in accordance with the following equation:

$$V_c=\sqrt{gD}$$

where D is the equivalent diameter of the largest opening in the restriction and g is the acceleration due to gravity. By means of further definition the term "equivalent diameter" means the relationship between the pressure drop caused by the frictional drag at the perimeter of a conduit or opening and the cross-sectional area of the opening or conduit expressed as the diameter of a circular opening evidencing the same phenomenon. The "diameter" of the opening being defined at times as four times the hydraulic radius (ratio of area to perimeter). See "Principles of Chemical Engineering" Walker, Lewis, McAdams and Gilliland; Third Edition, McGraw-Hill Book Company, 1937, page 93 et seq.

In accordance with the present invention a bored injection well is provided with an outer casing and an inner injection tube extending through the well casing to the locus of the gasification area containing the material to be gasified or subjected to in-situ combustion, e.g. oil or coal. Oxygen-rich gas is injected downwardly through the inner tube while steam or other moderating fluid (such as $CO_2$, $N_2$, air) is introduced to flow down the annulus surrounding the inner tube at a designed mass flow rate to satisfy the requirements of the gasification reactions to obtain the desired produced gas composition. Back flow of gaseous products into the annulus is prevented by restricting the cross-sectional flow area within said annulus at a location near the bottom of the annulus, thereby increasing the linear flow velocity of the gas flowing beyond said restriction to a predesigned rate such that backflow of combustible gas does not occur. In the manner hereinafter described the minimum linear flow velocity of the purge gas required to prevent upward flow of combustible gas into the annulus can be determined and suitable safety factors, as desired, incorporated in the design. The invention is applicable in installations wherein reaction steam is introduced through the annulus during oxygen injection as well as in operations wherein introduction of steam is in alternating sequence with that of oxygen introduction.

DESCRIPTION OF THE PREFERRED EMBODIMENT

The invention is concerned with underground gasification systems wherein an injection well is spaced from a production well and an underground gas flow channel is provided there between.

Figure 1:
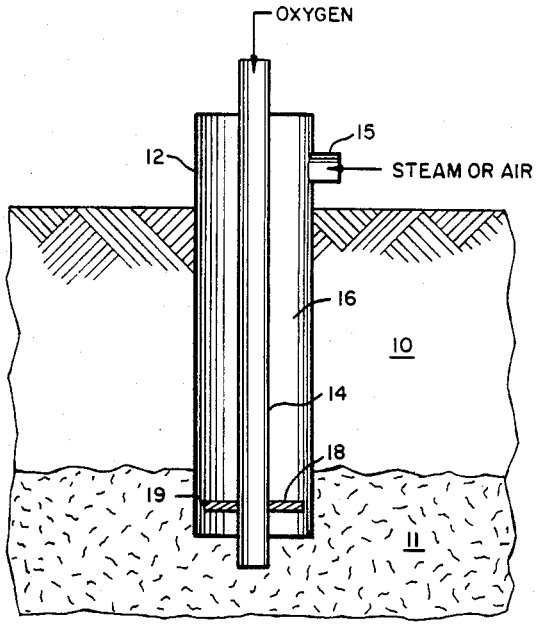
FIG. 1 is a diagrammatic vertical section of a typical injection well adapted for practice of the invention.

Referring to FIG. 1 of the accompanying drawings, there is shown a well bored through the overburden 10 down to a seam of coal 11 and a casing 12 arranged in the bore hole in well known manner. Concentrically arranged within the casing 12 is an injection tube or stringer 14 also extending into the coal seam. Both the casing 12 and the tube 14 extend above the surface of the earth. Tube 14 is of considerably smaller diameter than casing 12. For example, the casing may have an inner diameter in the order of about six to eight or more inches and the tube may have an outer diameter in the order of about two or three inches. Through suitable control valves (not shown) oxygen can be admitted through tube 14, while a purge gas (which may be inert or reactive, admitted through inlet 15, is flowed down the annulus 16 formed between the outer periphery of tube 14 and inner periphery of casing 12.

Within the annulus 16 and near the bottom thereof, a restricting disc or ring 18 is provided. In the embodiment illustrated in FIGS. 1 and 2 ring 18 fits tightly on tube 14 and extends downwardly therefrom for a distance short of reaching the inner periphery of casing 12 and thereby forming a purge fluid flow annulus 19. The determination of the design dimensions of the restricted flow path 19 is an important feature of the invention.

The significance of the relative flow areas will be appreciated from the following example. Assuming that the casing 12 had an I.D. of 8 inches, ignoring the presence therein of the tube 14, the cross-sectional area of casing 12 would be:

$$\frac{\pi \times (8)^2}{4} = 50.26 \text{ in.}^2 = 0.349 \text{ ft.}^2$$

The cross-sectional area occupied by tube 14 is:

$$\frac{\pi \times (2)^2}{4} = 3.14 \text{ in.}^2 = 0.02 \text{ ft.}^2$$

The area of the annular space 16 is:

$$50.26 - 3.14 = 47.12 \text{ in.}^2$$

or about 94% of the total cross-sectional area of casing 12.

Figure 2:
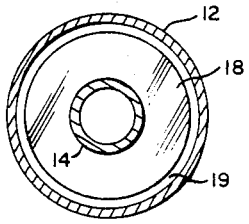
FIG. 2 is an enlarged cross-sectional view, showing one form of restriction that can be employed to reduce the cross-sectional flow area of the annulus between the inner tube and the outer well casing.

Assuming now in the embodiment illustrated in FIGS. 1 and 2 that the ring 18 has an outer diameter of 7.5 inches. The cross-sectional area of the ring and tube would be:

$$\frac{\pi \times (7.5)^2}{4} = 44.18 \text{ in.}^2 = 0.307 \text{ ft.}^2$$

and the restricted flow area 19 would be only:

$$50.26 - 44.18 = 6.08 \text{ in.}^2 = 0.042 \text{ ft.}^2$$

Figure 3:
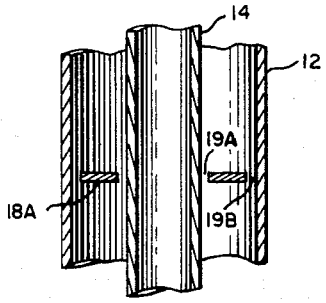
FIG. 3 is an enlarged partial vertical section of an alternative embodiment.

Instead of providing the restricted flow area as illustrated in FIG. 2, at the outer periphery of ther ring 18 and adjacent to the wall of the well casing 12, one may employ a ring 18 having an outer diameter equal to the inner diameter of the well casing and having a central hole therein of a proper diameter greater than the diameter of the inner tube 14. Thus, a restricted gas flow path will be had in the space left between the periphery of the central hole in the ring and the outer periphery of the tube. If desired, a ring 18A can be mounted in the annulus as shown in FIG. 3 by appropriate supporting structure (not shown) so as to provide two concentric gas flow paths, one adjacent to the outer periphery of the inner tube 14 and the other path adjacent to the inner wall of the casing 12, designated by reference numerals 19A and 19B, respectively.

Figure 4:
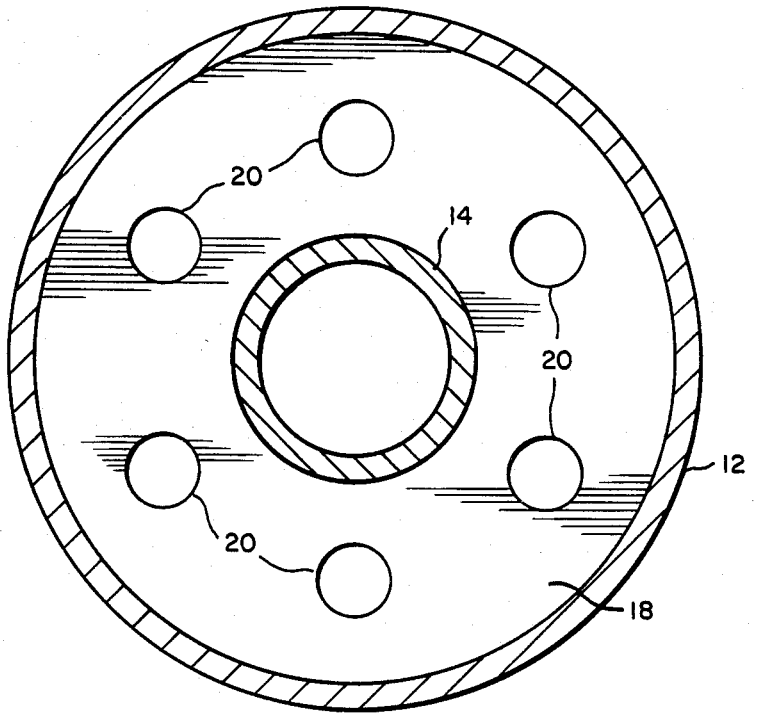
FIG. 4 is an enlarged cross-sectional view showing another alternative form of restriction that can be employed to reduce the cross-sectional area of the annulus between the inner conduit or tube and the outer well casing or well bore.

Referring now to FIG. 4 there is shown a still further embodiment of an apparatus of this invention wherein the ring 18 has an outer diameter equal to the inner diameter of the well casing and has a central circular hole therethrough of a diameter equal to the outer diameter of the inner tube 14. Thus, in this particular embodiment the plate 18 is in contact with both inner tube 14 and well casing 12 therby spanning the entire annular area defined therebetween. As shown in FIG. 4, plate 18 is provided with a series of equi-spaced and equi-diameter openings 20 extending through the plate 18. In this particular embodiment, the restricted gas flow path will be through the multiple openings in plate 18. As will be understood, plate 18 in this embodiment can be affixed to and in sealing relationship with both casing 12 and inner tube 14 employing means well known in the art.

In designing an installation for operation of a system of the type described, the following criteria must be taken into consideration to estimate the required linear flow velocity to prevent back flow of combustible gas ascending into the annulus. Of the combustible gases produced in the underground gasification of coal, the one presenting the greater danger with respect to back flow into the annulus, is hydrogen, not only because of its inherent ready combustibility but because of its low density. The ascension of one gas counter to a downwardly flowing stream of another gas results from the buoyancy of the lighter gas in the heavier descending stream. By considering the possible gas subject to back flow as hydrogen, a conservative safety criterion is had.

The phenomena involved in counter flow of fluids with respect to one another is the subject of extensive study by Wallis, G. B., "One-Dimensional Two-Phase Flow", McGraw-Hill, (1967) particularly at pages 339–357. The correlation as originally developed and presented in the Wallis text was for gas-liquid two-phase flow where there was a large density difference between the phases. The correlation was found to be applicable for liquid-liquid as well as for liquid-gas flow. In the present instance the criteria of Wallis are employed, with certain modifications and assumptions, in the case of a gas (such as air or steam) flowing downward in an annulus and a second gas (such as hydrogen) trying to ascend through the downwardly flowing gas stream by its buoyancy. The key problem is to determine at what downward gas velocity (say of air) will a "bubble" of hydrogen be prevented from moving upward through the annulus.

The correlation employed in designing a suitable arrangement for the purpose of the present invention, to estimate the needed purge gas downward velocity to prevent buoyant upflow of hydrogen, is:

$$j_p^* = \frac{V_p}{\sqrt{gD}}\left(\frac{\rho_p}{\rho_P - \rho_H}\right)^{\frac{1}{2}} \qquad \text{(I)}$$

wherein

- $j_p^*$ is a dimensionless variable as defined by the above mathematical expression (I);
- $V_p$ is the linear flow velocity of the purge gas in ft/sec;
- g is the gravity constant, 32.17 ft/sec$^2$;
- D is the internal diameter of the conduit in question;
- $\rho$ = gas density in pounds/ft$^3$;
- subscript p refers to the purge gas and subscript H refers to hydrogen.

To prevent backflow of hydrogen $j_p^*$ must be equal to or greater than unity. Since the density of hydrogen is much less than the density of the purge gas, equation (I) conservatively reduces to:

$$j_p^* = \frac{V_p}{\sqrt{gD}} \text{ or } V_p = j_p^* \sqrt{gD} \qquad \text{(II)}$$

The critical velocity necessary to prevent this backflow is designated herein as $V_c$ by setting $j_p^*$ equal to unity equation (II) can be rewritten as:

$$V_c = 1\sqrt{gD} = \sqrt{gD} \qquad \text{(III)}$$

In order to illustrate this invention in greater detail, reference is made to the following examples wherein the invention described herein is applied to varying situations.

EXAMPLE I

A seam of coal is subjected to underground gasification by injection of pure oxygen at a flow rate of 600 cfm, and the injection of enough additional air to provide a total oxidizing and carrier medium comprised of 90% oxygen and 10% nitrogen. The oxygen is injected through a stringer having an outside diameter of 0.167 feet (2 inches) which is located within a casing having an inside diameter of 0.667 feet (8 inches). The air is injected through the annular space between the stringer and the casing.

The pressure at the underground point of injection is 75 psig and the temperature near the point of injection is 500° F., because of the heat liberated by the gasification reaction.

The quantity of air ("Q"), required to dilute 600 cfm of oxygen to a mixture containing 90% oxygen is calculated by the following equations:

$$\frac{Q \times 0.21 + 600}{Q + 600} = 0.9$$

$$Q = 87.0\ CFM$$

In order to determine the actual volumetric flow of air at the point of injection, it is necessary to correct this standard volume of 87 cfm or 1.45 CF per sec. for the pressure and temperature. The increased pressure tends to reduce the volume while any increase in temperature tends to increase the volume. Although the temperature near the point of injection is much higher than the standard temperature, the gas flows through the stringer and annulus so fast that it is essentially still at the above-ground temperature as it emerges from the casing. Therefore, only a pressure correction is made:

$$Q(act) = Q(Std) \times \frac{P(std)}{Pact} = 1.45 \times \frac{14.7}{89.7} = 0.238\ CFS$$

The flow velocity of the air through the annulus is found by dividing the volumetric flow by the cross-sectional area of the annulus:

$$V = \frac{Q}{A}$$

$$A\ (\text{annulus}) = A\ (\text{casing}) - (\text{stringer})$$

$$A = \frac{\pi}{4}(D_c)^2 = \frac{\pi}{4}(Ds)^2$$

-continued $$= \frac{\pi}{4}[0.667^2 - 0.167^2] = 0.328 \text{ sq ft.}$$

$$V = \frac{0.238}{0.328} = 0.726 \text{ ft/sec.}$$

The critical velocity required to prevent backflow of potentially combustible and explosive gases or oxygen into the casing is given by the equation:

$$V(\text{critical}) = \sqrt{gD}$$
$$= \sqrt{32.2 \times 0.667} = 4.61 \text{ ft/sec}$$

Thus it is found that the actual flow velocity is far less than that required to prevent backflow, and this well is in danger of an explosion or underground fire in the casing.

EXAMPLE II

The injection well described in Example I is modified by the provision of a baffle which alters the flow conditions at the point of injection in a way to prevent backflow from the gasification chamber into the casing. The baffle consists of a circular plate containing six equally-spaced circular perforations of equal diameter, welded to the stringer and fitting closely within the casing. The clearance between the baffle and casing is such that essentially all air flows through the holes. Since the holes are of equal diameter and cross-sectional area, the flow of air is equally distributed among them, each hole receiving one-sixth of the total flow or 0.0395 cfs. The size of the holes which will ensure that the flow velocity through each hole is sufficient to prevent backflow is determined by the following calculations. The velocity through each hole is expressed as a function of its diameter:

$$V = \frac{Q}{A} = \frac{Q}{\frac{(\pi D^2)}{4}} = \frac{4}{\pi} Q \times \frac{1}{D^2}$$

This velocity is set equal to the critical velocity, which is also expressed as a function of the diameter:

$$V \text{ actual} = V \text{ critical}$$

$$\frac{4Q}{\pi} \times \frac{1}{D^2} = \sqrt{gD}$$

This equation is in turn solved for diameter (D):

$$D = \left(\frac{4Q}{\pi\sqrt{g}}\right)^{2/5} = \left(\frac{4 \times 0.0395}{3.142\sqrt{32.2}}\right)^{2/5} = 0.151 \text{ ft.}$$

$$0.151 \times 12 = 1.81 \text{ inches}$$

Thus, the baffle plate containing six holes, each no larger than 1.81 inches in diameter, prevents backflow of gas into the casing and the well is operated safely.

EXAMPLE III

The well of Example I is modified by the installation of a baffle to modify flow characteristics so that backflow will not occur. This baffle consists of a solid circular plate welded to the stringer and having an outside diameter (Di) less than that of the casing. Air flow is restricted to the annular opening between the periphery of the baffle and the casing.

The diameter of the baffle is chosen so that the actual linear velocity (Va) of the air flow through the annular opening is at least equal to the critical velocity (Vc) required to prevent backflow. For a non-circular passage, such as an annular space, the equivalent diameter, as given on page 5–4 of the "Chemical Engineers Handbook", (Fifth Edition, McGraw Hill Book Company, New York 1973) is employed for flow calculations. The equivalent diameter is defined as four times the cross-sectional area of the passage divided by its total perimeter. A series of diameters are assumed for the baffle, and for each one of the equivalent diameter, the cross-sectional area, the actual flow velocity through the annular opening and the critical velocity for the opening are calculated. The results of the calculations are shown in the following table.

| Diameter of Baffle (inches) | Equivalent Diameter of Annulus (in) | Velocity (ft/sec) Actual | Critical |
|---|---|---|---|
| 5.0 | 3 | .12 | .34 |
| 5.5 | 2.5 | .29 | .59 |
| 6.0 | 2.0 | .56 | .32 |
| 6.5 | 1.5 | 2.01 | 1.01 |
| 7.0 | 1.0 | 2.91 | 64 |
| 7.5 | 0.5 | 5.63 | .16 |

It is apparent from this table that at baffle diameters less than 6.5 inches the actual flow velocity is less than the critical velocity, and back flow occurs. At diameters equal to or greater than 6.5 inches the flow velocity is equal to or greater than the critical velocity and the well is operated safely.

What is claimed:

1. In the underground gasification of carbonaceous material in-situ through a bored injection well by the method which comprises injecting oxygen-rich gas through a conduit within said well while flowing a combustion-moderating fluid downwardly within the well in a flow path externally of said conduit, said moderating fluid being flowed at a predetermined mass flow rate sufficient to satisfy the requirements of the gasification product composition, the improvement which comprises placing a restriction in the flow path of said moderating fluid so as to restrict the cross-sectional flow area at the restriction such that at said predetermined mass flow rate the average flow velocity, defined as the volumetric flow rate at the conditions existant at the restriction divided by the total open area of the restriction, is at least equal to the critical flow velocity Vc at the restriction as given by the formula:

$$V_c = gD$$

where D is the equivalent diameter of the restricted cross-sectional flow area and g is the acceleration due to gravity.

2. An improved method according to claim 1 wherein said restriction in the flow path of said moderating fluid spans the entire flow path of said moderatng fluid and has a plurality of openings extending therethrough, wherein the average flow velocity through each opening is at least equal to the critical flow velocity, $V_c$, for such opening and wherein D is the equivalent diameter for such opening.

3. An injection well for underground gasification of carbonaceous solids by partial reaction with oxidizing gas in the presence of a moderating fluid, said well having an outer casing surrounding a gas injection tube within said casing for introduction of oxidizing gas into the bottom of said well, and providing a second gas flow path in said casing externally of said injection tube, adapted to be used for admission of moderating fluid to the bottom of said well; gas flow restricting means in said second gas flow path for providing a restricted flow area within said second path, such that at a predetermined mass flow rate of the moderating fluid, the downward gas flow velocity through the restricted flow area at the restricting means corresponds to the formula $$V_c = gD$$

wherein g is the gravity constant and D is the equivalent diameter of the the restricted flow area at the restricting means.

4. An injection well according to claim 3 wherein said gas flow restricting means is in the form of a ring having an inner disc fitting tightly on said gas injection tube near the lower end thereof and extending outwardly therefrom for a distance short of reaching the inner periphery of said outer casing.

5. An injection well according to claim 3 wherein said gas flow restricting device is in the form of an annular disc having an outer diameter equal to the inner diameter of said outer casing and having a central hole therein of a diameter greater than that of said gas injection tube.

6. An injection well according to claim 3 wherein said gas flow restricting device is an annular disc mounted adjacent the lower end of said gas injection tube and spaced from the outer periphery of said tube and from the inner wall of said casing.

7. An injection well according to claim 3 wherein said gas flow restricting means is in the form of a disc in substantially sealing relation with both the injection tube and the outer casing, which disc also has means defining at least one opening therethrough.

8. An injection well according to claim 3 wherein said gas flow restricting means spans the entire second gas flow path and has a plurality of openings extending therethrough such that at a predetermined mass flow rate of the moderating fluid, the gas flow velocity through each of the openings is at least equal to the critical flow velocity, $V_c$, for such opening and wherein D is the equivalent diameter for such opening.

* * * * *